United States Patent [19]

Gorstein

[11] Patent Number: 4,596,944

[45] Date of Patent: Jun. 24, 1986

[54] ELECTRIC LIGHT BULB SAVING DEVICE

[76] Inventor: Illan Gorstein, Industrial Center, Netanya, Israel

[21] Appl. No.: 594,236

[22] Filed: Mar. 28, 1984

[30] Foreign Application Priority Data

Mar. 31, 1983 [IL] Israel ..... 68276

[51] Int. Cl.[4] ..... H05B 37/00

[52] U.S. Cl. ..... 315/185 R; 313/1; 315/66; 315/122

[58] Field of Search ..... 315/66, 122, 185 R, 315/185 S, 189; 362/227, 234, 253; 313/1

[56] References Cited

U.S. PATENT DOCUMENTS

| | | | |
|---|---|---|---|
| 777,666 | 12/1904 | Dale | 362/227 |
| 780,087 | 1/1905 | Burt | 313/1 |
| 814,162 | 3/1906 | Phelps | 315/66 |
| 931,724 | 8/1909 | Benjamin | 362/227 |
| 1,873,309 | 8/1932 | Doane | 362/227 |
| 2,042,963 | 6/1936 | Rentschaler et al. | 313/1 |
| 2,306,559 | 12/1942 | Pearson | 315/66 |
| 3,319,115 | 5/1967 | Smith | 315/185 R |
| 4,425,605 | 1/1984 | Cheng | 315/185 R |

*Primary Examiner*—Harold Dixon

*Attorney, Agent, or Firm*—Toren, McGeady, Stanger, Goldberg & Kiel

[57] ABSTRACT

In order to prolong the life of incandescent electric light bulbs, an arrangement is provided which consists of two bulbs, one of which constitutes a resistance for the second one.

The lamp holder which accommodates the two bulbs comprises two sockets into each of which the base of one bulb is inserted, the two sockets being interconnected in series.

2 Claims, 4 Drawing Figures

ELECTRIC LIGHT BULB SAVING DEVICE

BACKGROUND OF THE INVENTION

The present invention concerns incandescent light bulbs and more particularly deals with the problem of extending the life-time of incandescent light bulbs.

Incandescent light bulbs used for street lighting have to be replaced as soon as possible after having "burnt out". This is within the responsibility of town or city organisations who have to rely on a maintenance staff kept for that and for like purposes.

Even more difficult becomes the situation in those cases where incandescent light bulbs are used in apartment buildings in which public areas, such as, courtyards, staircases and like places are lighted by means of such bulbs. Here, the responsibility for replacing burnt out light bulbs is frequently shared by many, the result being that replacement is not effected as quickly as required.

As is well known, the life-time of an incandescent bulb is governed by the quality of the glowing wire and by the voltage under which the lamp operates.

Reducing the voltage fed to a light bulb may result in prolonging the effective life-time of the latter. It is known to reduce the voltage by means of resistances, transformers or dimming devices. These, however, are quite expensive to install and themselves have a limited life-time. Moreover, devices of this kind are consumers of energy which is practically lost.

OBJECT OF THE INVENTION

It is the object of this invention to provide an inexpensive and safe lighting arrangement for prolonging the life-time of electric, incandescent light bulbs.

SHORT SUMMARY OF DISCLOSURE

In its broadest aspects the invention is based on the idea of using an incandescent light bulb as resistance for and relative to another such bulb, the two light bulbs being interconnected in series.

In a practical embodiment of the invention a special lamp holder is provided which is designed to accommodate two light bulbs and comprises connectors which connect in series the two sockets into which the bases of the bulbs are inserted. The sockets may be of conventional design, screw threaded or of any other conventional type, in accordance with the type of the respective lamp bases.

In installing a device according to the present invention and comprising two light bulbs, the voltage fed to the device is halved for each one of the light bulbs, thus prolonging their life-time—as has been surprisingly found—almost indefinitely. At the same time, the energy fed to both bulbs is efficiently used for lighting and is not lost.

By way of example, if a certain location is to be served by say a 500 watt bulb, the new device is installed and two bulbs, each destined for 1000 watts are inserted. The two bulbs, as has been stated, are connected in series, which means that each receives only 50% of the voltage and the actual light effect of each is only that of 250 watts, but together they supply the full desired lighting effect.

SHORT DESCRIPTION OF THE DRAWINGS

The invention will now be described in detail with reference to the annexed drawings. In these FIG. 1 shows schematically the wiring circuit for use with the new device.

DESCRIPTION OF PREFERRED EMBODIMENT

Figure 1:
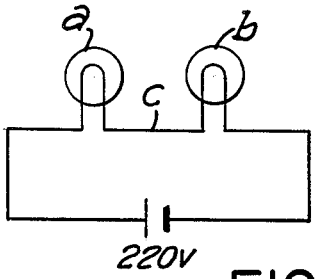

The circuit shown in FIG. 1 is self-explanatory and requires no detailed description. It is assumed that two electric bulbs a and b are fed from a source of 220 V current. The two lamps are interconnected via a.lead c in a manner which will become clear from the following.

Figure 2:
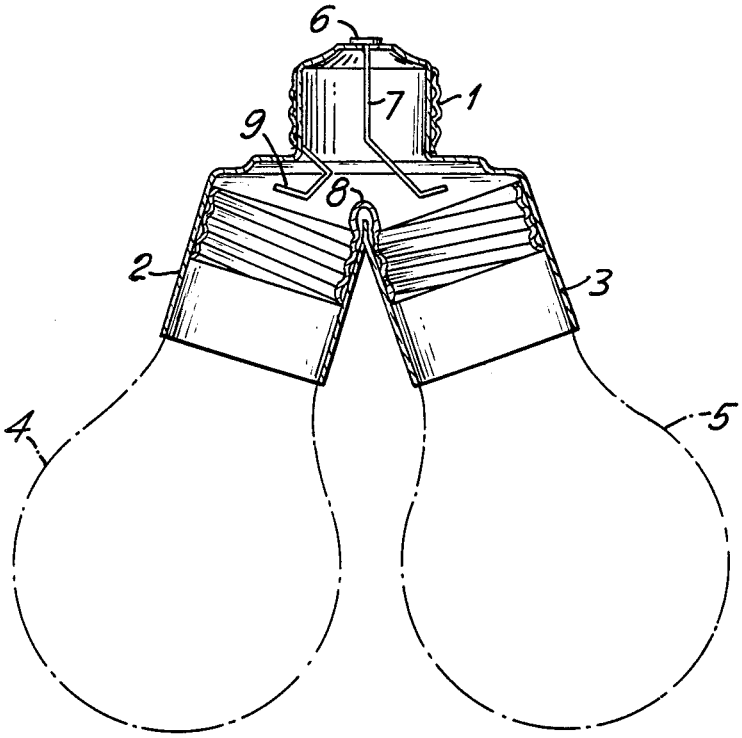
FIG. 2 is a sectional view of one embodiment of a lamp holder incorporating the invention.

Turning now to FIG. 2, there is shown a device comprising an externally screw threaded base 1 to which are fixedly connected two sockets 2 and 3 which are internally screw threaded. Into sockets 2 and 3 screw the bases of two electric light bulbs 4 and 5. The outer end of base 1 has the conventional contact terminal 6 from which a lead 7 goes to the inner, top end of socket 3, at which point it comes into contact with the end of the base of bulb 3. The interior (metallic) screw threads in sockets 2 and 3 and are connected by a conductor 8.

Assuming that the bulbs 4 and 5 are in position, being screwed into sockets 4 and 5, current will flow from terminal 6 via conduit 7 to the internal screw thread of socket 3 (and supply current to bulb 5). From socket 3, the current flows via conductor 8 to socket 2 (feeding bulb 4) and through it and a terminal 9, base 1 to terminal 6.

Full voltage is available at terminal 6, but each of sockets 2 and 3 receive 25% of the total.

Figure 3:
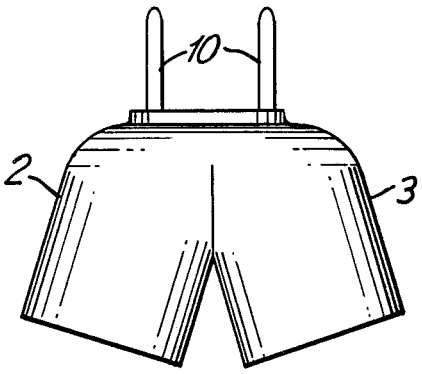
FIGS. 3 and 4 are further examples of lamp holder devices according to the invention.
Figure 4:
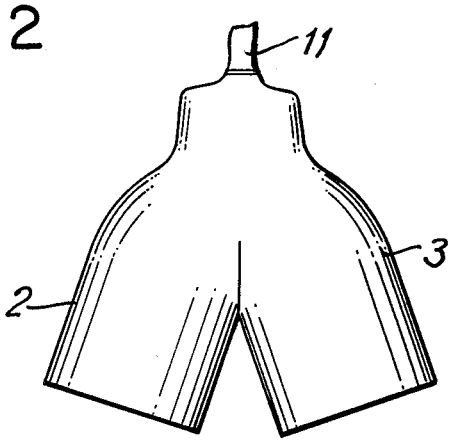

The sockets 2, 3 in FIG. 3 are equivalents of those shown in FIG. 2 but instead of the base 1 there are provided two pins which can be plugged into a wall socket. Similarly the two sockets 2, 3 of FIG. 4 may be connected by wires 11 to whatever source.

I claim:

1. A lighting arrangement for providing a predetermined rated light output corresponding to a predetermined wattage utilizing a predetermined voltage, comprising two incandescent light bulbs connected in series, wherein the rated wattage resistance of each bulb is selected to be a multiple of said predetermined wattage so that said two light bulbs together provide said predetermined rated light output and the bulbs have a longer life because of their lower current conduction.

2. The lighting arrangement claims in claim 1, comprising a lamp holder for accommodating said two light bulbs, said lamp holder comprising two sockets into which said two bulbs are inserted, and connecting means for connecting said two sockets in series with one another.

* * * * *